United States Patent [19]

Hooper et al.

[11] Patent Number: 4,578,682

[45] Date of Patent: Mar. 25, 1986

[54] ANTENNA DISH

[75] Inventors: Robert L. Hooper; Lawrence W. Yonge, III, both of Ocala, Fla.

[73] Assignee: Raydx Satellite Systems, Ltd., Ocala, Fla.

[21] Appl. No.: 591,421

[22] Filed: Mar. 20, 1984

[51] Int. Cl.[4] ..... H01Q 15/16

[52] U.S. Cl. ..... 343/916

[58] Field of Search ..... 343/912, 915, 916, 840

[56] References Cited

U.S. PATENT DOCUMENTS

| | | | |
|---|---|---|---|
| 2,471,828 | 5/1949 | Mautner | 343/916 |
| 3,832,717 | 8/1974 | Taggart | 343/915 |
| 4,201,991 | 5/1980 | Vines | 343/840 |
| 4,268,835 | 5/1981 | Taggart | 343/915 |
| 4,528,569 | 7/1985 | Felter et al. | 343/916 |

*Primary Examiner*—Eli Lieberman

*Attorney, Agent, or Firm*—Duckworth, Allen, Dyer & Pettis

[57] ABSTRACT

An antenna dish structure is disclosed having a central support to which are attached a plurality of elongated ribs extending radially outwardly with a plurality of metallic mesh members extending between adjacent pairs of rib, and a rim structure connected to the outer ends of the ribs, with both the ribs and the rim having portions for receiving therewithin such mesh members.

11 Claims, 7 Drawing Figures

FIG. 1
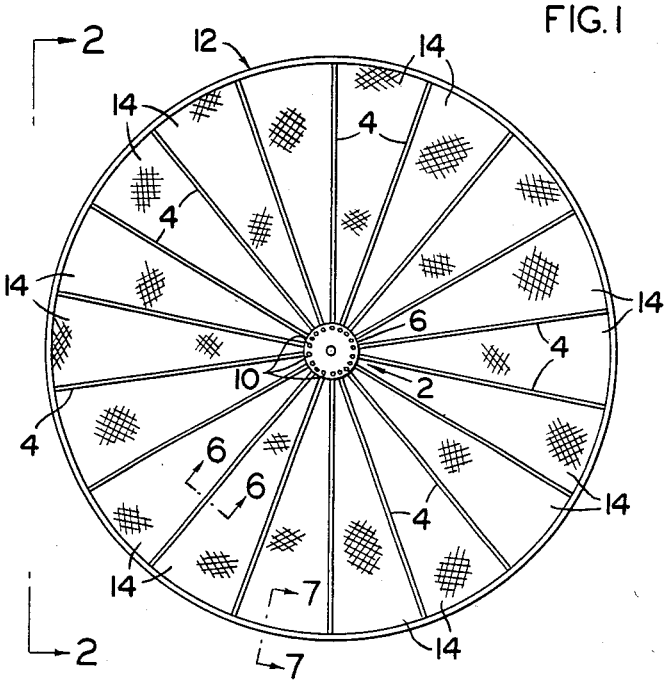
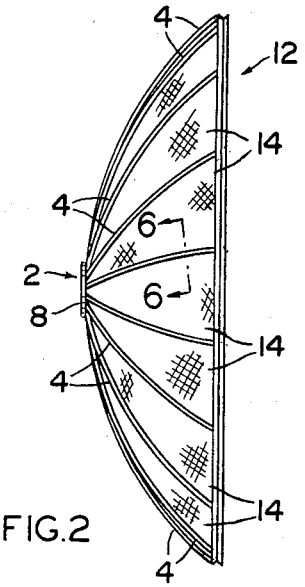
FIG. 2
FIG. 3
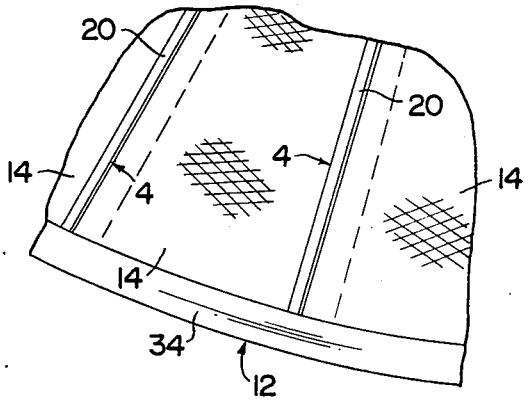
FIG. 4
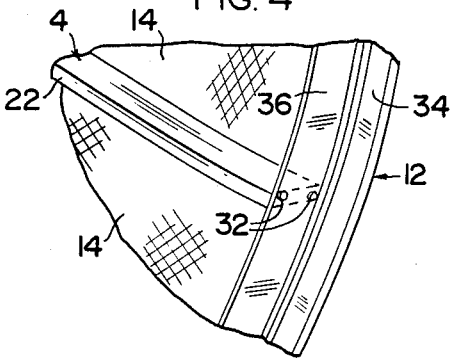
FIG. 5
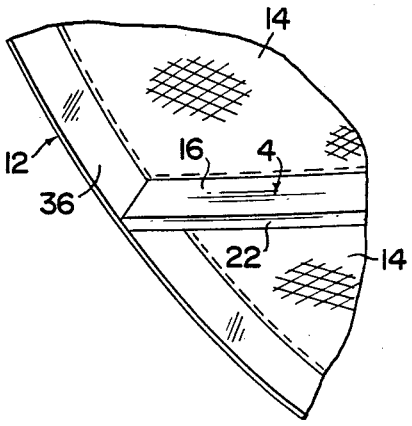
FIG. 6
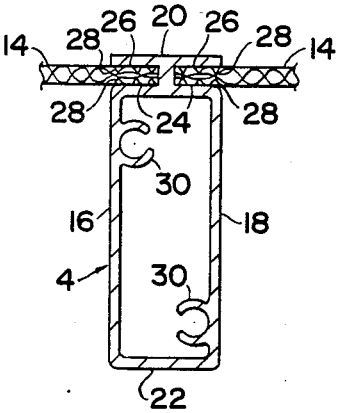
FIG. 7
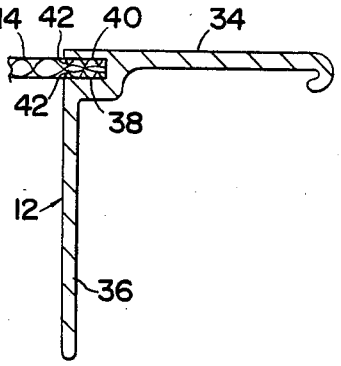

ANTENNA DISH

BACKGROUND OF THE INVENTION

This invention relates to the field of dish antennas. More particularly, it relates to construction of the dishes for such antennas.

Antennas for receiving electromagnetic signals, such as television signals transmitted from satellites, customarily are of the general configuration of a dish comprising a portion of a paraboloid. This configuration provides for the reflection and focusing of received signals onto a detecting element placed in front of the surface of the dish.

Numerous approaches of construction of such apparatus have been developed. These include structures made out of sheet metal and spun to the parabolic configuration or fabricated from a plurality of wedge-shaped pieces of sheet metal having simple curves and fastened together to form a dish approximating a paraboloid. Additionally, such dishes have been formed out of glass fiber reinforced resin and other synthetic materials. All of these configurations have functional to greater or lesser degrees of satisfaction, but all of them have the disadvantages of undesirable weight and windage, or air resistance.

Recently, such antenna dishes have also been fabricated out of a framework having a plurality of ribs with a metallic signalreflecting mesh filling the spaces between the ribs. Because the mesh provides substantially no structural strength or rigidity it has generally been necessary to provide truss-like supports for the ribs to establish sufficient rigidity for the dish. Additionally, the numerous components comprising such antenna dishes and their ribs and supporting members has generally required extensive assembly and set up time and the use of a large number of fasteners and other components. While these structures have reduced the windage of the antenna dishes, they frequently have remained heavier than desirable, increasing the expense and difficulty of shipping these structures to installation sites.

SUMMARY OF THE INVENTION

In order to overcome the disadvantages of the prior art structures, it is an object of the present invention to provide such an antenna dish that is simple and lightweight. It is an additional object to provide such an antenna dish that provides substantial rigidity while utilizing a reflective mesh for a substantial portion of the reflector surface.

To achieve these and other objects, an antenna dish is disclosed, such as may be used for reflecting and focussing electromagnetic signals such as television signals transmitted from satellites. The dish of this invention includes a centrally disposed supporting structure for supporting the components of the dish, a plurality of elongated forming ribs each attached at one end thereof to the supporting structure and extending generally radially outwardly therefrom, a plurality of foraminous metallic mesh members extending radially outwardly from the supporting structure and between a pair of adjacent such forming ribs, and a rim structure connected to the end of each such forming rib distal the supporting structure. Each of the forming ribs is bent in one plane to form a portion of a generally parabolic curve, and the ribs include mesh receiving portions to receive a portion of the metallic mesh therewithin. In a preferred embodiment the rim structure also includes a mesh receiving portion for receiving therewithin a portion of each mesh member distal the supporting structure, whereby the mesh members and ribs form a generally parabolic dish structure for reflecting and focusing the electromagnetic signals.

BRIEF DESCRIPTION OF THE DRAWINGS

A preferred embodiment of the antenna dish of this invention is disclosed below in which:

FIG. 1 is a front elevation of the dish of this invention;

FIG. 2 is a side elevation of the dish of FIG. 1;

FIG. 3 is a fragmentary front perspective view, at an enlarged scale, of a portion of the dish of FIG. 1 adjacent to rim thereof;

FIG. 4 is a fragmentary rear perspective view, at an enlarged scale, of a portion of the dish of FIG. 1 adjacent the rim thereof, viewed from behind and outside the rim;

FIG. 5 is a fragmentary rear perspective view, at an enlarged scale, of a portion of the dish of FIG. 1, at an enlarged scale;

FIG. 6 is a sectional view of one of the ribs of the dish of FIGS. 1 and 2, taken along lines 6—6 in FIG. 2 and illustrated at a substantially enlarged scale; and FIG. 7 is a sectional view of a portion of the rim structure of the dish of FIGS. 1 and 2, taken along lines 7—7 of FIG. 1 and illustrated at a substantially enlarged scale.

DESCRIPTION OF A PREFERRED EMBODIMENT

A particularly preferred embodiment of the antenna dish of this invention is illustrated in FIGS. 1 through 7. This antenna dish preferably is optimized for reflecting and focusing for reception and use electromagnetic signals such as television signals transmitted from satellites. Obviously, such a dish antenna could be utilized for numerous other similar types of applications, both in receiving and transmitting such signals. The dish antenna of FIG. 1 may suitably be between 10 and 15 feet in diameter, although numerous other sizes could be made equally well.

In general, this dish comprises a central supporting means, generally indicated by reference number 2, to which are attached a plurality of elongated forming ribs 4 extending generally radially outwardly therefrom. The supporting means 2, which is disposed centrally of the dish, may suitably comprise a pair of aluminum plates 6 and 8 (FIG. 2) between which are fastened one end of each of the forming ribs 4 by means of suitable fasteners 10, which may be stainless steel bolts.

At the end of each forming rib 4 distal the supporting means 2 is connected rim means 12 in the form of a generally circular member. Such distal ends of the ribs 4 are connected to that rim structure in a manner to be described below. Extending between each pair of adjacent forming ribs 4 and between the central supporting structure 2 and the rim structure 12 are a plurality of foraminous metallic mesh members 14, which suitably may be formed of a commercially available expanded aluminum whose characteristics provide for the desired reflection of the electromagnetic signals.

FIGS. 3 through 5 illustrate fragmentary views of different portions of the antenna dish of FIGS. 1 and 2 on a substantially enlarged scale to illustrate better the details of such structure. FIG. 3 is a view taken from in front of the dish and adjacent the lower portion of the rim thereof. FIG. 4 illustrates another section of the dish, this view being from behind and outside the rim, and FIG. 5 is yet another view taken from behind and inside the rim. These views, along with the sectional views of FIGS. 6 and 7 illustrate more clearly the construction of this embodiment of the dish.

Each forming rib 4 preferably is formed of an aluminum extrusion having the generally rectangular configuration shown in the cross-sectional view of FIG. 6. This extrusion, which may suitably be of type 6105 aluminum, includes a pair of mutually opposed side surfaces 16 and 18, and a pair of mutually opposed top and bottom surfaces 20 and 22, respectively. In forming the rib, the side surfaces 16 and 18 remain generally planar when the rib is bent into its generally parabolic curve, with the top and bottom surfaces 20 and 22 thus following a generally parabolic curve.

Each of the rib tubular members 4 includes at least one, and in this embodiment two, recesses extending inwardly thereof, each such recess being defined by a pair of mutually opposed generally parallel surfaces 24 and 26. These surfaces 24 and 26 are spaced apart a distance approximating the thickness of the mesh 14 that is received within the recess. Additionally, at least one, and preferably both, of these surfaces 24 and 26 have a plurality of projections 28, which may be in the form of ridges or teeth, extending outwardly from those surfaces to engage portions of the mesh 14 to assist in gripping and retaining that mesh member within the recess. The interior of the tubular member 4 may include, as a portion of the extrusion, one or more bosses 30 for receiving threaded fasteners, such as bolts or screws 32 illustrated in FIG. 4, extending through and attaching the rim member 12 to the ribs 4.

The rim member 12, illustrated in the enlarged cross-sectional view of FIG. 7, may suitably be formed of an aluminum extrusion having a generally L-shaped cross section with two generally orthogonal portions 34 and 36. This extrusion suitably may also be of type 6105 aluminum. This rim member 12 is formed into a generally circular shape and suitably may be fabricated of a plurality of pieces fastened together in a conventional manner. As illustrated in FIG. 7, a first one of the orthogonal portions, portion 34 in this illustration, is configured to be generally parallel to adjacent portions of the mesh members 14. These mesh members 14 preferably are received into a recess in the rim member 12 that is generally similar in configuration to the recesses in the rib member 4. The recess extends generally parallel to and adjacent the first orthogonal portion 34 and is formed by a pair of mutually opposed and generally parallel surfaces 38 and 40, which are spaced apart a distance approximating the thickness of the mesh member 14 to be received therewithin. Again similar to the structure of the rib members 4, this recess includes on at least one, and preferably both, of the surfaces 38 and 40 a plurality of projections extending outwardly therefrom, such that those projections may engage portions of the mesh member 14 to retain that mesh member within the recess. The second orthogonal portion 36 of the rim member 12 may engage the outer ends of each rib 4, as illustrated in FIG. 5 and may be fastened thereto in the manner shown in FIG. 4 with fasteners 32 threaded into the bosses 30 in the ribs 4.

By providing the first orthogonal portion 34 of the rim member member 12 configured to be generally parallel to adjacent portions of the received mesh member 14, the upper surface of that rim portion 34 may serve as an additional portion of the reflecting and focusing surface of the antenna dish.

From the foregoing description of the components comprising this antenna dish, it may be seen that the structure may be assembled easily and quickly. The steps in such assembly would include the connection of a plurality of rib members 4 to the central supporting structure 2, insertion of the mesh members 14 into the respective rib recesses and then attachment of the rim member 12, also receiving within its recess the radially outermost portions of the mesh members 14. This provides for rapid and simple assembly of this lightweight structure.

Although the foregoing describes a particularly preferred embodiment of the antenna dish of this invention, it is to be understood that such description is illustrative only of the principles of this invention and is not limitative thereof. Because numerous variations and modifications of this structure, all within the scope of the invention, will readily occur to those skilled in the art, the scope of this invention is to be limited solely by the claims appended hereto.

What is claimed:

1. An antenna dish, such as may be used for reflecting and focusing electromagnetic signals such as television signals transmitted from satellites for reception and use, comprising centrally disposed supporting means for supporting the components of the dish;

a plurality of elongated forming ribs, each comprising a tubular member that is bent prior to assembly of said dish to form a portion of generally parabolic curve, each said tubular rib having formed integrally therewith mesh receiving portions comprising at least one recess extending inwardly of said tubular member and generally parallel to said parabolic surface thereof for receiving a portion of metallic mesh therewithin, each said rib being attached at one end thereof to said centrally disposed supporting means and extending generally radially outwardly therefrom;

a plurality of foraminous metallic mesh members each formed of a mesh material reflective of said signal and extending between a pair of adjacent said forming ribs and received within said mesh receiving portions thereof and each extending radially outwardly continuously from a position adjacent said centrally disposed supporting means to a position adjacent the end of said ribs distal said supporting means; and rim means connected to the end of said forming rib distal said supporting means, whereby the mesh members and ribs extending continuously outwardly from the centrally disposed supporting means form a generally parabolic dish structure for reflecting and focusing such signals.

2. The antenna dish of claim 1 wherein each said tubular rib member comprises an extrusion having said mesh receiving recess formed integrally within said extrusion.

3. The antenna dish of claim 2 wherein said rib tubular member has a generally rectangular cross section with two opposed surfaces thereof being generally planar and two other mutually opposed surfaces thereof being bent into said generally parabolic curve.

4. The antenna dish of claim 3 wherein said mesh receiving portion of said rib tubular member comprises at least one recess extending inwardly of said tubular member and generally parallel to said generally parabolically bent surfaces thereof.

5. The antenna dish of claim 4 wherein said mesh receiving portion of said rib tubular member comprises two mutually opposed said recesses adjacent one of said generally parabolically bent surfaces.

6. The antenna dish of claim 5 wherein each said recess is defined by a pair of mutually opposed, generally parallel surfaces spaced apart a distance approximating the thickness of said mesh member received therewithin, with at least one of said recess surfaces having a plurality of projections extending outwardly therefrom, whereby the projections may engage portions of the mesh member to retain that mesh member within the recess.

7. The antenna dish of claim 1 wherein said rim means comprises a generally circular member having a generally L-shaped cross section with two generally orthogonal portions.

8. The antenna dish of claim 11 wherein said rim circular member is formed such that a first one of said orthogonal portions is generally parallel to adjacent portions of said received mesh member, whereby that surface of the rim circular member serves as an additional portion of the reflecting and focusing surface of the antenna dish.

9. The antenna dish of claim 8 wherein said rim means mesh receiving portion comprises a recess in said circular member extending generally parallel to and adjacent said first orthogonal portion.

10. The antenna dish of claim 9 wherein said circular member recess is defined by a pair of mutually opposed and generally parallel surfaces spaced apart a distance approximating the thickness of said mesh member received therewithin, with at least one of said recess surfaces having a plurality of projections extending outwardly therefrom, whereby the projections may engage portions of the mesh member to retain that mesh member within the recess.

11. The antenna dish of claim 7 wherein said rim means includes a mesh receiving portion for receiving therewithin the portion of each said mesh member distal said supporting means.

* * * * *